US007461422B1

(12) United States Patent
Baker

(10) Patent No.: US 7,461,422 B1
(45) Date of Patent: Dec. 9, 2008

(54) ALARM PILLOW AND ASSOCIATED METHOD

(76) Inventor: Carl Baker, 42 Stafford Ave., Apt. B 3, Bristol, CT (US) 06010

( * ) Notice: Subject to any disclaimer, the term of this patent is extended or adjusted under 35 U.S.C. 154(b) by 61 days.

(21) Appl. No.: 11/724,842

(22) Filed: Mar. 16, 2007

Related U.S. Application Data

(60) Provisional application No. 60/782,661, filed on Mar. 16, 2006.

(51) Int. Cl.
*A47G 9/00* (2006.01)
*G04B 47/00* (2006.01)

(52) U.S. Cl. ..... 5/639; 5/636; 5/904; 368/10; 368/12

(58) Field of Classification Search ..... 5/639, 5/636, 904, 645; 368/10, 12
See application file for complete search history.

(56) References Cited

U.S. PATENT DOCUMENTS 2,962,731 A * 12/1960 Bounds ..... 5/639
3,175,230 A * 3/1965 Herdal ..... 5/491
3,863,283 A * 2/1975 Mohr ..... 5/639
4,309,784 A * 1/1982 Cohen ..... 5/639
5,072,429 A * 12/1991 Mair ..... 368/10
5,138,728 A * 8/1992 Aston ..... 5/645
5,144,600 A * 9/1992 Cheng ..... 368/12
5,864,903 A * 2/1999 Newman ..... 5/639
6,081,949 A * 7/2000 Delicia ..... 5/639
6,236,621 B1 5/2001 Schettino
6,525,268 B1 * 2/2003 Sellers ..... 174/561
D492,204 S 6/2004 Clevenger
7,089,617 B1 * 8/2006 Lauro ..... 5/636
7,380,298 B2 * 6/2008 Hernandez ..... 5/639

* cited by examiner

*Primary Examiner*—Alexander Grosz

(57) ABSTRACT

An alarm pillow and associated method includes a pillow with an opening at a proximal end thereof, a core member, and an outer layer positioned thereabout. A cavity is formed between the core member and the outer layer respectively. The cavity has an open end defined along the proximal opening of the pillow, and a closed distal end seated medially of the proximal end and a distal end of the pillow respectively. A portable electronic alarm device is removably positioned within the cavity. The device has a planar top surface with a user interface, and a planar bottom surface extending parallel to the top surface. The device is slidably positional through the proximal opening of the cavity and abuts against the distal end of the cavity.

12 Claims, 3 Drawing Sheets

ALARM PILLOW AND ASSOCIATED METHOD

CROSS REFERENCE TO RELATED APPLICATIONS

This application claims the benefit of U.S. Provisional Application No. 60/782,661, filed Mar. 16, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pillows and, more particularly, to a combined alarm pillow and associated method for providing a discrete notifying signal to a user during sleeping conditions.

2. Prior Art

Alarm clocks are a necessary part of almost everyone's daily lives, from schoolchildren to working parents. As such, alarm clocks are available in a wide variety of styles to meet the tastes of an individual. Most alarm clocks are of a tabletop variety that rests on a nightstand next to a user bed. Such alarm clocks are separated from a user pillow and distanced from the user during operation. Such separation means that a user must remember both the pillow and the alarm clock, when traveling, to ensure being awakened at the proper time. If a user forgets to bring the alarm clock, the user must purchase another or rely on an internal clock, the sun, or some other method to awaken at a desired time. However, some alarm clocks are integrally attached to a user pillow and provide both an audible alarm, as well as a vibrating function to awaken a user.

One prior art example shows an under-pillow vibrating assembly that resists relative displacement between itself and a pillow, and reliably transmits vibrations through the pillow to wake a sleeper. The assembly includes a housing containing a vibrator as well as a planar vibratory plate connected to, and extending past, opposite ends outwardly of, the housing. Unfortunately, this prior art example is a device that is separate from a pillow and has the same drawbacks as a traditional alarm clock. In addition, such an under-pillow can become lost, thereby preventing use of same with an existing pillow, and also does not provide an audible alert as well as a vibrating alert.

Another prior art example shows a pillow alarm device for waking up a user. The device includes a pillow having a compartment therein with an alarm clock provided in the compartment. A vibrating device is also provided in the compartment. The vibrating device is adapted for vibrating the pillow to wake a user resting on the pillow when activated. The vibrating device is electrically connected to the alarm clock so that the alarm clock activates the vibrating device when an alarm of the alarm device is activated. Unfortunately, this prior art example has a compartment for housing the alarm clock partially disposed on an outside surface of the pillow, thereby possibly causing user discomfort when a user body part contacts the compartment during operating conditions.

Accordingly, a need remains for an alarm pillow and associated method in order to overcome the above-noted shortcomings. The present invention satisfies such a need by providing a device that is convenient and easy to use, is lightweight yet durable in design, and provides a discrete notifying signal to a user during sleeping conditions. Such a device rouses a sleeper with a gentle vibration, without disturbing a bed partner or anyone else in the house, thereby allowing others to remain sleeping. Such a device can be utilized in every room of a house where sleeping takes place, and can effectively remove the need for an alarm clock in those areas. The device also provides a traditional audible alarm if a user desires. The present invention is simple to use, inexpensive, and designed for many years of repeated use.

BRIEF SUMMARY OF THE INVENTION

In view of the foregoing background, it is therefore an object of the present invention to provide a system for an alarm pillow and associated method. These and other objects, features, and advantages of the invention are provided by an alarm and pillow system for providing a discrete notifying signal to a user during sleeping conditions.

The system includes a pillow provided with an opening formed at a proximal end thereof and effectively spanning across an entire width of the pillow. Such a pillow further includes a core member and an outer layer advantageously positioned thereabout, and has a cavity formed between a top surface of the core member and a bottom surface of the outer layer respectively. Such a cavity has a proximal open end effectively defined along the proximal opening of the pillow, and further has a closed distal end seated medially of the proximal end and a distal end of the pillow respectively. The cavity extends along a top portion of the outer layer and advantageously remains spaced from a bottom portion of the outer layer such that the alarm device (herein described below) remains permanently seated on a top surface of the core member while positioned within the cavity. A bottom region of the outer layer directly abuts a bottom region of the core member.

The core member has a proximal end permanently and directly attached to a bottom lip of the proximal end of the pillow. Such a proximal end of the core member is conveniently spaced below a top lip of the proximal end of the pillow such that the core member remains statically affixed to the bottom lip when the top lip of the proximal end of the pillow is biased to an open position.

The system further includes a portable electronic alarm device removably positioned within the cavity of the pillow. Such an alarm device has a planar top surface conveniently provided with a user interface, and further has a planar bottom surface extending parallel to the top surface of the alarm device. The alarm device is slidably positional through the proximal opening of the cavity and abuts directly against the distal end of the cavity such that the alarm device is effectively prohibited from traveling beyond the distal end of the cavity during sleeping conditions. The alarm device is advantageously intercalated between the top portion of the outer layer and the top surface of the core member.

The system further includes a mechanism for selectively opening and closing the proximal open end of the pillow while the alarm device is housed within the cavity.

A method for providing a discrete notifying signal during sleeping conditions includes the steps of providing a pillow that has an opening formed at a proximal end thereof and spanning across an entire width of the pillow. Such a pillow includes a cavity formed therein. The steps further include positioning a core member within the cavity such that the core member abuts an outer layer of the pillow, providing a portable alarm device for sounding an alarm during periodic intervals, programming an alarm start time in the alarm device, removably positioning the alarm device within the cavity of the pillow, abutting the alarm device directly against a distal end of the cavity, determining when the alarm device is triggered by the alarm start time, reaching into the cavity and retrieving the alarm device therefrom, toggling the alarm device to an off position, and slidably repositioning the alarm device into the cavity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
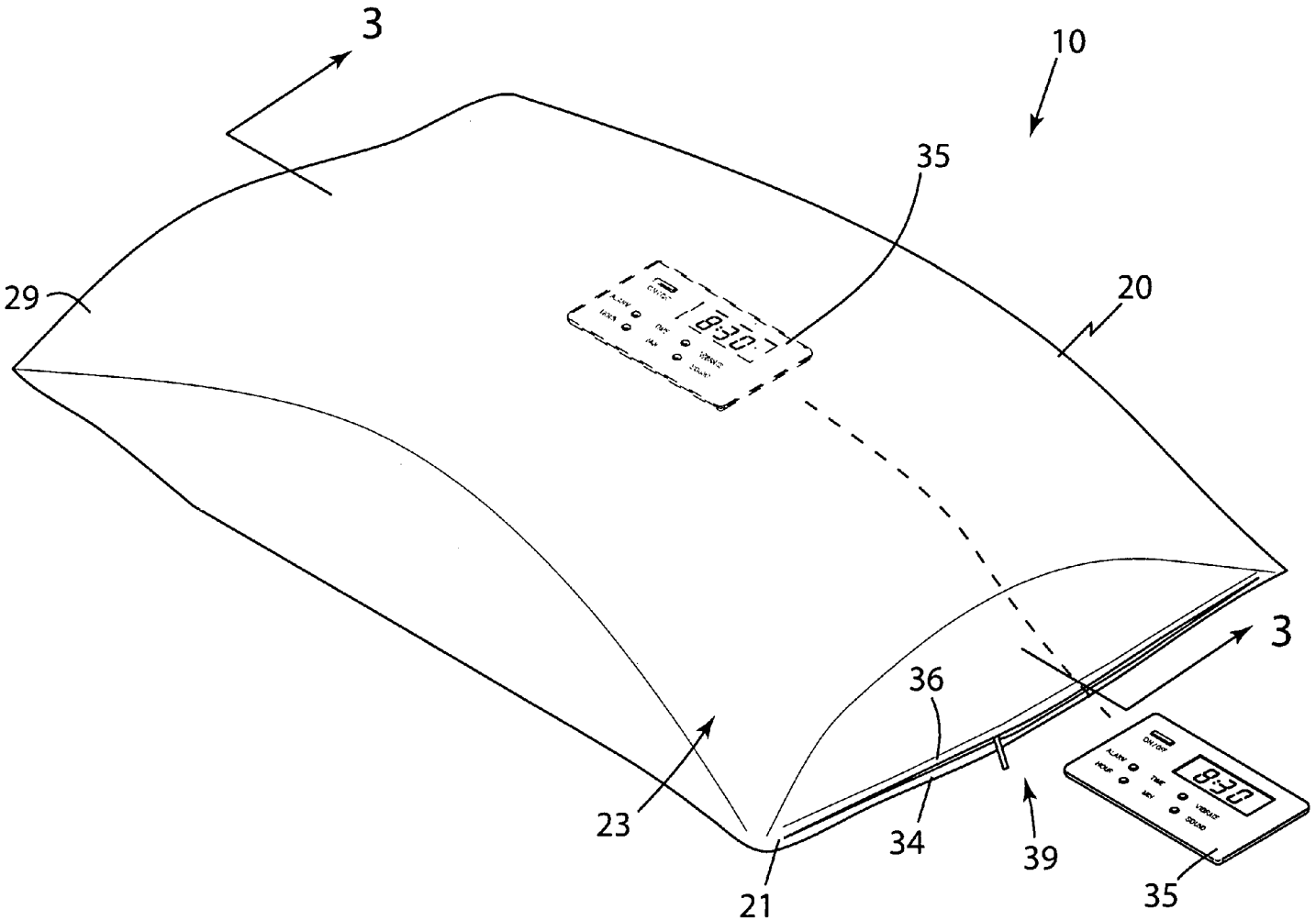
FIG. 1 is a perspective view of the system showing the pillow and the alarm device respectively, in accordance with the present invention.
Figure 2:
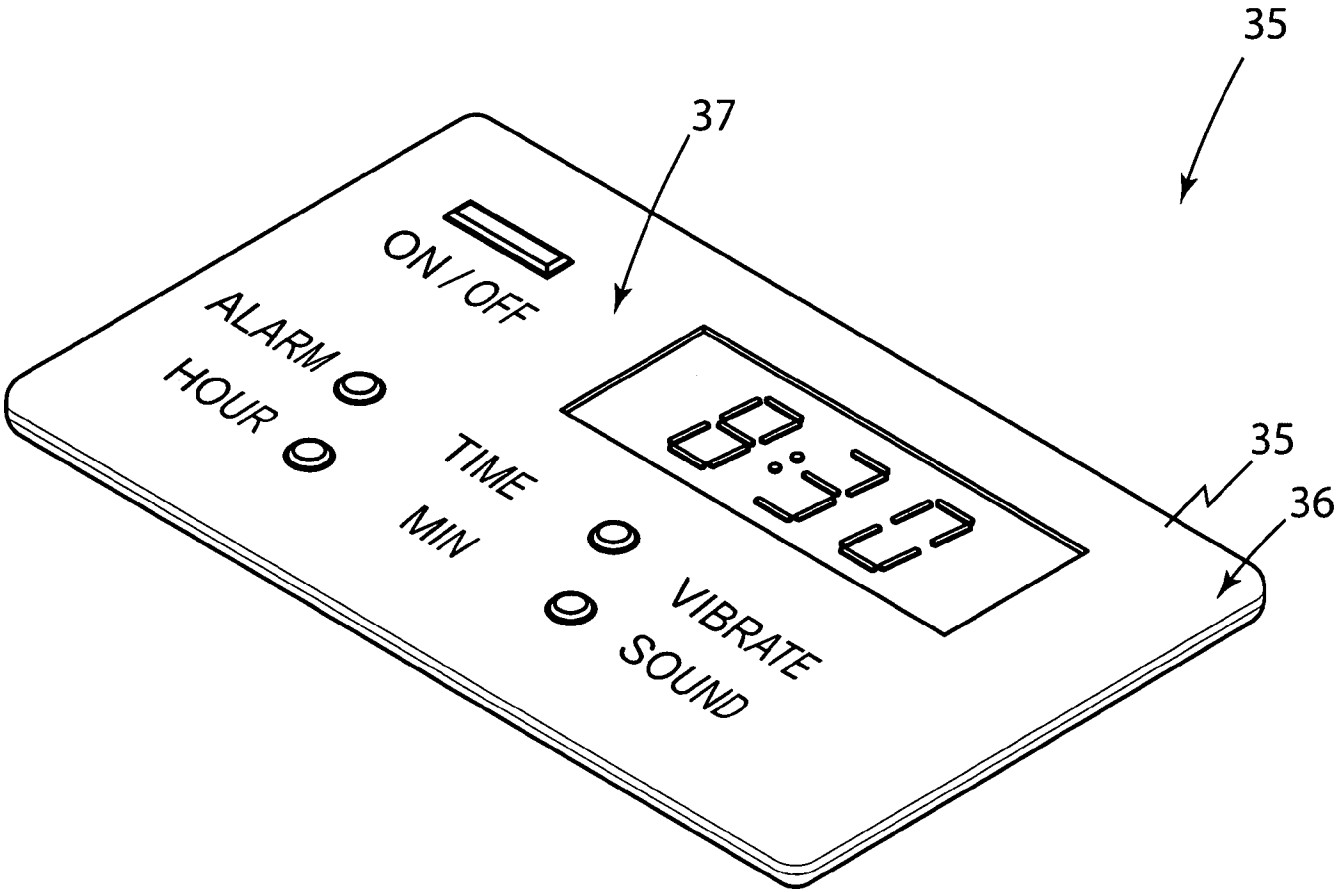
FIG. 2 is perspective view of the alarm device shown in FIG. 1.
Figure 3:
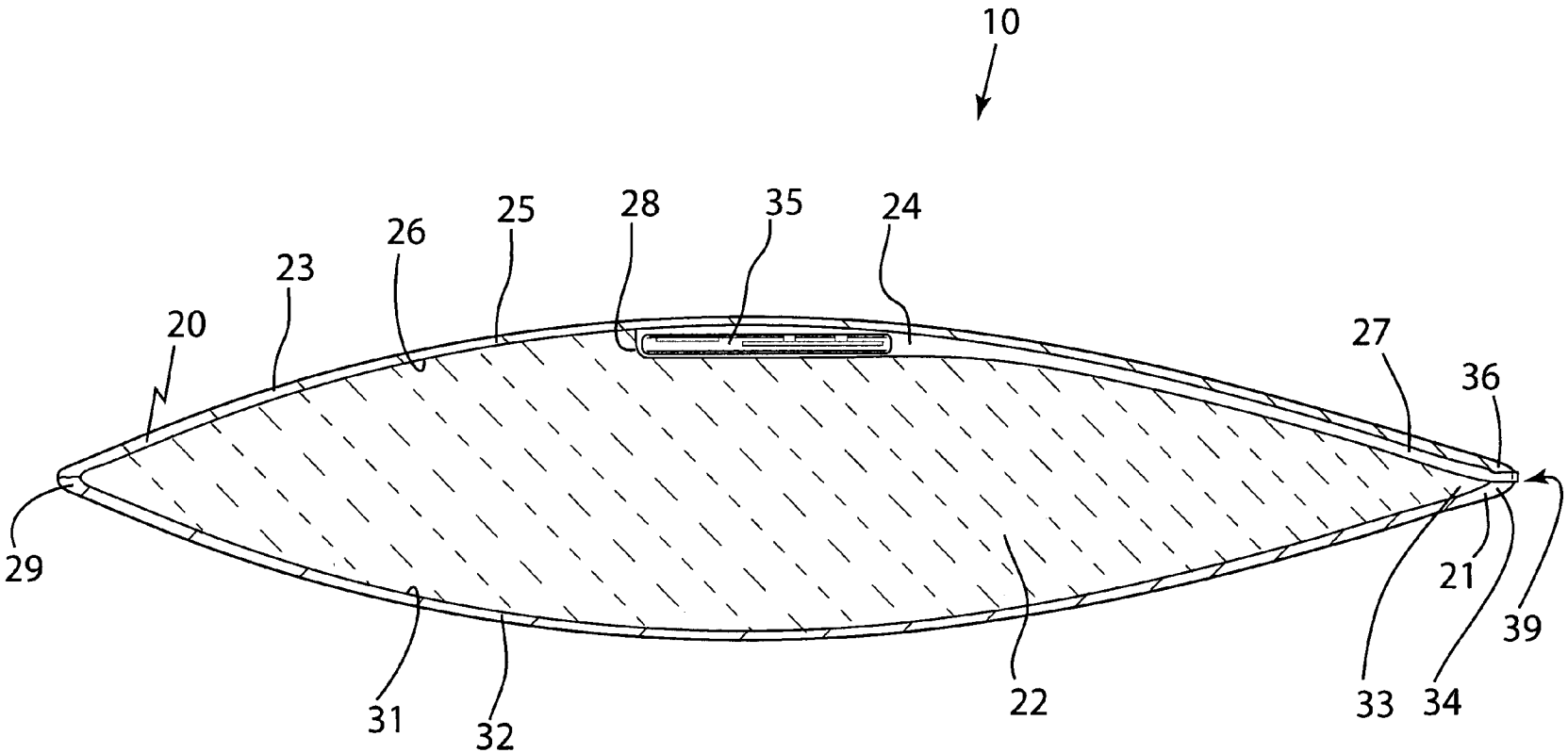
FIG. 3 is a cross sectional view of the pillow shown in FIG. 1, taken along line 3-3.

The system of this invention is referred to generally in FIGS. 1-3 by the reference numeral 10 and is intended to provide an alarm pillow and associated method. It should be understood that the system 10 may be used to alert many different types of individuals in many different types of environments and should not be limited in use to alerting only those types of individuals in those types of environments described herein.

Referring initially to FIGS. 1 and 3, the system 10 includes a pillow 20 provided with an opening formed at a proximal end 21 thereof and spanning across an entire width of the pillow 20. Such a pillow 20 further includes a core member 22 and an outer layer 23 advantageously positioned thereabout, and has a cavity 24 formed between a top surface 25 of the core member 22 and a bottom surface 26 of the outer layer 23 respectively. Such an outer layer 23 provides a comfortable surface against which a user skin rests during operating conditions. Such a cavity 24 has a proximal open end 27 defined along the proximal opening of the pillow 20, and further has a closed distal end 28 seated medially of the proximal end 21 and a distal end 29 of the pillow 20 respectively.

Again referring to FIGS. 1 and 3, the cavity 24 extends along a top portion of the outer layer 23 and advantageously remains spaced from a bottom portion of the outer layer 23, which is essential such that the alarm device 35 (herein described below) remains permanently seated on a top surface 25 of the core member 22 while positioned within the cavity 24. By positioning the alarm device 35 as described above, the user is more efficiently awakened by the system 10. A bottom region 31 of the outer layer 23 directly abuts a bottom region 32 of the core member 22.

Referring to FIG. 3, the core member 22 has a proximal end 33 permanently and directly attached to a bottom lip 34 of the proximal end 21 of the pillow 20, without the use of intervening elements. Such a proximal end 21 of the core member 22 is spaced below a top lip 36 of the proximal end 21 of the pillow 20, which is critical such that the core member 22 remains statically affixed to the bottom lip 34 when the top lip 36 of the proximal end 21 of the pillow 20 is biased to an open position. Such a permanent attachment of the core member 22 to the pillow 20 eliminates the possibility of misplacing one of the elements and thereby rendering the invention 10 useless for its intended purpose.

Referring to FIGS. 1, 2 and 3, the system 10 further includes a portable electronic alarm device 35 removably positioned within the cavity 24 of the pillow 20. Such an alarm device 35 has a planar top surface 36 provided with a user interface 37, and further has a planar bottom surface extending parallel to the top surface 36 of the alarm device 35. Such a user interface 37 allows the user to easily set an alarm time into the alarm device 35, as well as selectively choose an audible or vibrating alert as desired.

The alarm device 35 is slidably positional through the proximal open end 27 of the cavity 24 and abuts directly against the distal end 28 of the cavity 24, without the use of intervening elements, which is crucial such that the alarm device 35 is prohibited from traveling beyond the distal end 28 of the cavity 24 during sleeping conditions. By prohibiting the alarm device 35 from traveling beyond the distal end 28 of the cavity 24, the user is assured that the alarm device 35 is in the optimal position for alerting the user when the alert time entered into the alarm device 35 is reached. The alarm device 35 is advantageously intercalated between the top portion of the outer layer 23 and the top surface 25 of the core member 22.

Yet again referring to FIGS. 1 and 3, the system 10 further includes a mechanism 39 for selectively opening and closing the proximal open 21 end of the pillow 20 while the alarm device 35 is housed within the cavity 24. Such an opening and closing mechanism 39 can include a wide variety of closures including a zipper, buttons, snaps, and hook-and-loop closures, as examples.

In use, the alarm pillow and associated method 10 is simple and straightforward to use. First, the user purchases the desired number of systems 10. Following package instructions, the user next sets the correct time on the alarm device 35, sets the desired time to be awakened, and activates the alarm device 35. Then, when awakened, the user deactivates the alarm device 35.

The ability of the user to position the alarm device 35 within the cavity 24 of the pillow 20 provides the unexpected benefit of allowing a user to travel with the system 10 in one convenient unit, thereby eliminating the possibility of forgetting or losing one of the essential elements of system 10 and thus rendering the invention 10 useless for its intended purpose. In addition, placement of the alarm device 35 within the cavity 24 eliminates discomfort to a user skin surface during operating conditions caused by a compartment disposed on an exterior surface of the pillow 20.

A method 10 for providing a discrete notifying signal during sleeping conditions includes the steps of providing a pillow 20 that has an opening formed at a proximal end 21 thereof and spanning across an entire width of the pillow 20. Such a pillow 20 includes a cavity 24 formed therein. The steps further include positioning a core member 22 within the cavity 24 such that the core member 22 abuts an outer layer 23 of the pillow 20, providing a portable alarm device 35 for sounding an alarm during periodic intervals, programming an alarm start time in the alarm device 35, removably positioning the alarm device 35 within the cavity 24 of the pillow 20, abutting the alarm device 35 directly against a distal end 28 of the cavity 24, without the use of intervening elements, determining when the alarm device 35 is triggered by the alarm start time, reaching into the cavity 24 and retrieving the alarm device 35 therefrom, toggling the alarm device 35 to an off position, and slidably repositioning the alarm device 35 into the cavity 24.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined alarm and pillow system for providing a discrete notifying signal to a user during sleeping conditions, said combined alarm and pillow system comprising:

a pillow provided with an opening formed at a proximal end thereof and spanning across an entire width of said pillow, said pillow further including a core member and an outer layer positioned thereabout, said pillow further having a cavity formed between a top surface of said core member and a bottom surface of said outer layer respectively, said cavity having a proximal open end defined along said proximal opening of said pillow, said cavity further having a closed distal end seated medially of said proximal end and a distal end of said pillow respectively; and a portable electronic alarm device removably positioned within said cavity of said pillow, said alarm device having a planar top surface provided with a user interface, said alarm device further having a planar bottom surface extending parallel to said top surface of said alarm device;

wherein said alarm device is slidably positional through said proximal opening of said cavity and abuts directly against said distal end of said cavity such that said alarm device is prohibited from traveling beyond said distal end of said cavity during sleeping conditions;

wherein said core member has a proximal end permanently and directly attached to a bottom lip of said proximal end of said pillow, said proximal end of said core member being spaced below a top lip of said proximal end of said pillow such that said core member remains statically affixed to said bottom lip when said top lip of said proximal end of said pillow is biased to an open position.

2. The combined alarm and pillow system of claim 1, wherein said cavity extends along a top portion of said outer layer and remains spaced from a bottom portion of said outer layer such that said alarm device remains permanently seated on a top surface of said core member while positioned within said cavity.

3. The combined alarm and pillow system of claim 1, further comprising: means for selectively opening and closing said proximal open end of said pillow while said alarm device is housed within said cavity.

4. The combined alarm and pillow system of claim 1, wherein said alarm device is intercalated between said top portion of said outer layer and said top surface of said core member.

5. A combined alarm and pillow system for providing a discrete notifying signal to a user during sleeping conditions, said combined alarm and pillow system comprising:

a pillow provided with an opening formed at a proximal end thereof and spanning across an entire width of said pillow, said pillow further including a core member and an outer layer positioned thereabout, said pillow further having a cavity formed between a top surface of said core member and a bottom surface of said outer layer respectively, said cavity having a proximal open end defined along said proximal opening of said pillow, said cavity further having a closed distal end seated medially of said proximal end and a distal end of said pillow respectively;

wherein a bottom region of said outer layer directly abuts a bottom region of said core member; and a portable electronic alarm device removably positioned within said cavity of said pillow, said alarm device having a planar top surface provided with a user interface, said alarm device further having a planar bottom surface extending parallel to said top surface of said alarm device;

wherein said alarm device is slidably positional through said proximal opening of said cavity and abuts directly against said distal end of said cavity such that said alarm device is prohibited from traveling beyond said distal end of said cavity during sleeping conditions;

wherein said core member has a proximal end permanently and directly attached to a bottom lip of said proximal end of said pillow, said proximal end of said core member being spaced below a ton lip of said proximal end of said pillow such that said core member remains statically affixed to said bottom lip when said top lip of said proximal end of said pillow is biased to an open position.

6. The combined alarm and pillow system of claim 5, wherein said cavity extends along a top portion of said outer layer and remains spaced from a bottom portion of said outer layer such that said alarm device remains permanently seated on a top surface of said core member while positioned within said cavity.

7. The combined alarm and pillow system of claim 5, further comprising: means for selectively opening and closing said proximal open end of said pillow while said alarm device is housed within said cavity.

8. The combined alarm and pillow system of claim 5, wherein said alarm device is intercalated between said top portion of said outer layer and said top surface of said core member.

9. A method for providing a discrete notifying signal during sleeping conditions, said method comprising the steps of:

a. providing a pillow having an opening formed at a proximal end thereof and spanning across an entire width of said pillow, said pillow having a cavity formed therein;

b. positioning a core member within said cavity such that said core member abuts an outer layer of said pillow;

c. providing a portable alarm device for sounding an alarm during periodic intervals;

d. programming an alarm start time in said alarm device;

e. removably positioning said alarm device within said cavity of said pillow;

f. abutting said alarm device directly against a distal end of said cavity;

g. determining when said alarm device is triggered by said alarm start time;

h. reaching into said cavity and retrieving said alarm device therefrom;

i. toggling said alarm device to an off position; and j. slidably repositioning said alarm device into said cavity;

wherein said core member has a proximal end permanently and directly attached to a bottom lip of said proximal end of said pillow, a proximal end of said core member being spaced below a top lip of said proximal end of said pillow such that said core member remains statically affixed to said bottom lip when said top lip of said proximal end of said pillow is biased to an open position.

10. The method of claim 9, wherein said cavity extends along a top portion of said outer layer and remains spaced from a bottom portion of said outer layer such that said electronic device remains permanently seated on a top surface of said core member while positioned within said cavity.

11. The method of claim 9, further comprising:

means for selectively opening and closing said proximal open end of said pillow while said electronic device is housed within said cavity.

12. The method of claim 9, wherein said electronic device is intercalated between a top portion of said outer layer and a top surface of said core member.

* * * * *